US007690627B2

(12) United States Patent
Harpell

(10) Patent No.: US 7,690,627 B2
(45) Date of Patent: Apr. 6, 2010

(54) TOOL BLADE

(76) Inventor: William Harpell, 2380 Findlay Rd., Joyceville, Ontario (CA) K0H 1Y0

( * ) Notice: Subject to any disclaimer, the term of this patent is extended or adjusted under 35 U.S.C. 154(b) by 104 days.

(21) Appl. No.: 12/002,703

(22) Filed: Dec. 19, 2007

(65) Prior Publication Data

US 2008/0099737 A1 May 1, 2008

Related U.S. Application Data

(63) Continuation of application No. 11/412,539, filed on Apr. 28, 2006, now abandoned.

(51) Int. Cl.
*B66F 15/00* (2006.01)

(52) U.S. Cl. ..... 254/25; 254/21; 254/131

(58) Field of Classification Search ..... 254/25, 254/21, 26 R, 18, 131, 20, 177.8, 119
See application file for complete search history.

(56) References Cited

U.S. PATENT DOCUMENTS 742,771 A 10/1903 Arrington
2,382,831 A * 8/1945 Tabellione ..... 254/25
3,893,200 A 7/1975 Wanciak
6,113,074 A 9/2000 Foley
6,308,934 B1 * 10/2001 Gallo ..... 254/25
6,986,504 B1 * 1/2006 Eby et al. ..... 254/25
7,025,331 B2 * 4/2006 Whelan ..... 254/25
7,039,993 B1 5/2006 Smith et al.
2003/0042474 A1 3/2003 Boydon
2004/0227131 A1 * 11/2004 Wood ..... 254/25

* cited by examiner

*Primary Examiner*—Lee D Wilson

(57) ABSTRACT

A pulling tool for grabbing and pulling material from underneath structural elements. The tool has a handle, the handle having a main body portion and having one flat end portion bent from one end of the body portion. A thin, narrow, claw member is attached to the free end of the one end portion and extends across and past both sides of the one end portion to form a claw on each side of the handle at one end of the handle. Each claw is tapered to a straight end edge which edge is transverse to the end portion. Each claw has a narrow v-shaped material receiving slot extending inwardly from the straight end edge to allow the claw to grab the material being removed.

6 Claims, 2 Drawing Sheets

TOOL BLADE

BACKGROUND OF THE INVENTION

1. Field of the Invention

This invention is directed toward a pulling tool for pulling articles, or portions thereof, out from under constructional elements or other awkward locations.

2. Description of the Related Art

It is often difficult to remove all of the article, such as a shingle or carpet, when replacing it. Often, the article is installed partly under another article or structure that is not being replaced, and it is difficult to remove that portion of the article being replaced that is covered by the other article or structure. In the case of roof shingles, for example, an edge portion of the shingles to be replaced can be covered with roof flashing that stays in place during shingle replacement. The portion of the shingles under the flashing is difficult, and thus time consuming, to remove. When replacing carpeting, an edge portion of the carpeting is often under baseboard moulding and again it is difficult to remove the carpet edge portion without removing the moulding.

SUMMARY OF THE INVENTION

It is the purpose of the present invention to provide a tool that makes it easier to remove all of the article that is being replaced, including a partly covered portion of the article.

In accordance with the present invention there is provided a tool having a handle with a claw at one end portion of the handle, the claw extending sideways from the handle. The handle has a straight main body portion and a flat end portion that extends from one end of the body portion and is bent to extend away from the longitudinal axis of the body portion. The claw is attached to the free end of the one end portion of the handle to extend laterally from it. The claw is formed by a narrow, thin, elongate claw member with a wide side and a narrow side, the claw member attached by its wide side to the end portion. The free end of the claw is tapered to provide a wide edge, the edge being transverse to the free end of the end portion. The claw has a v-shaped slot extending inwardly from its wide edge for gripping a portion of an edge of an article.

The tool is manoeuvred, by the user using the handle, to first slip the claw under the permanent article overlying the article to be removed and to then grip the edge of the removable article under the permanent article in the slot in the claw. Because of the bend in the end portion of the handle, the claw can be placed flat on the surface being worked on while the body portion of the handle is slightly raised from the surface so the tool can be gripped and manoeuvred. Once the article has been securely gripped in the slot by the claw the handle is used to pull the article out from under the permanent article. The tool is fairly small and lightweight and is easy to use to remove the article. The tool can have a claw at the other end of the handle for removing the odd nail or fastener encountered in the job which requires removing, or for slightly loosening the permanent article covering the article to be removed.

The tool, in a preferred embodiment, has a double claw at the working end of the tool, one claw on each side of the handle so the tool can be used from the left or right side. The double claw is formed by a narrow, thin, elongate claw member extending across the free end of the one end portion of the handle and generally centered with respect to the free end of the end portion. The ends of the claw member are shaped and slotted to form the claws.

The invention is particularly directed toward a pulling tool having a handle, the handle having a straight main body portion and having one flat end portion extending from one end of the body portion, the end portion having a free end. A thin, narrow, claw member is attached to the free end of the end portion and extends laterally therefrom to one side of the handle to form a claw with a free end portion. The free end of the claw is tapered to form a straight end edge which end edge is parallel to an imaginary straight plane bisecting the width of the entire handle. The claw has a narrow v-shaped material receiving slot extending inwardly from the straight end edge.

Preferably, the end portion of the handle is bent and terminates in a straight section, the claw member attached to the free end of the straight section. The straight section extends at an angle to the longitudinal axis of the body portion of the handle that ranges between fifteen degrees and thirty degrees.

DESCRIPTION OF THE PREFERRED EMBODIMENTS

Figure 1:
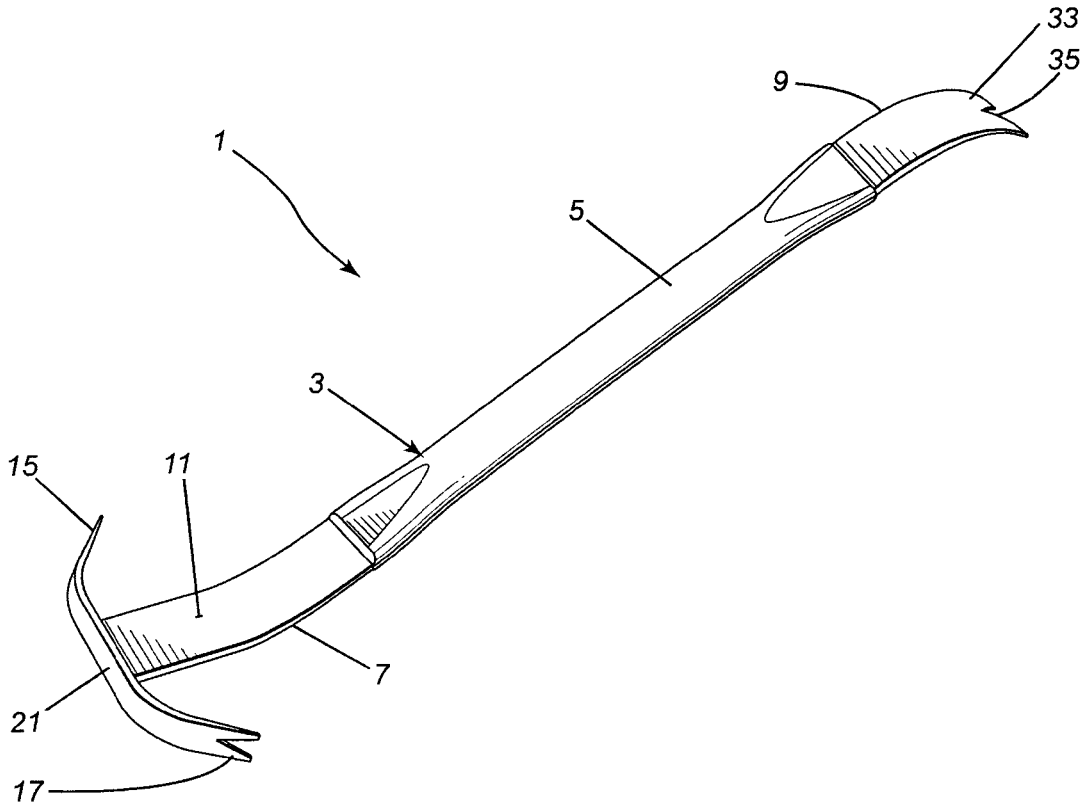
FIG. 1 is a perspective view of the tool.
Figure 2:
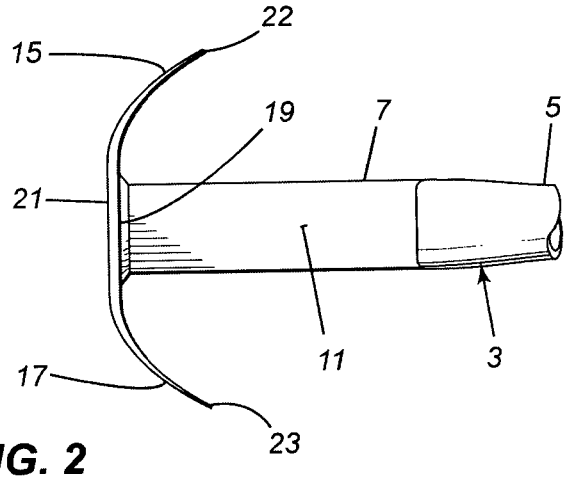
FIG. 2 is a partial top view of the tool.
Figure 3:
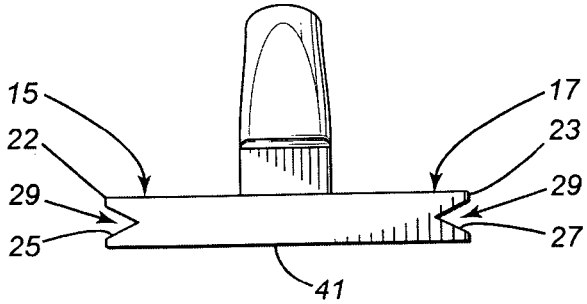
FIG. 3 is a partial front view of the tool.
Figure 4:
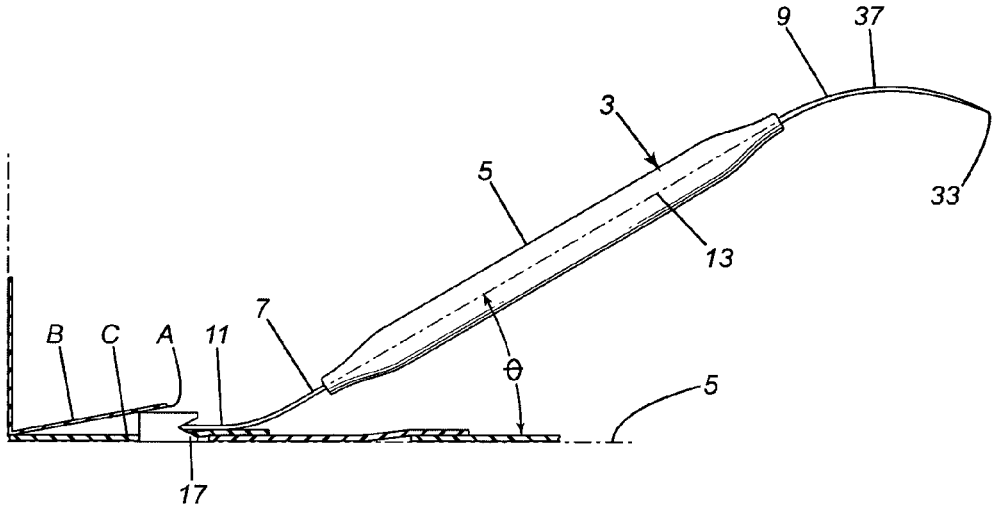
FIG. 4 is a side view of the tool being used.

The tool 1, as shown in FIGS. 1 to 3, has a handle 3 with a main tubular body portion 5 and a flat end portion 7, 9 at each end of the body portion 5. The main body portion 5 is straight and two to three times the length of the flat end portions 7, 9. When the main body portion 5 of the handle 3 is horizontal, one flat end portion 7 is bent upwardly and terminates in a straight end section 11. The other flat end portion 9 is bent downwardly in a direction opposite to the direction in which the first end portion 7 is bent from the main body portion 5. The straight end section 11 extends at a shallow angle Ø to the longitudinal axis 13 of the main body portion 5 of the handle as shown in FIG. 4. The angle Ø is about twenty to twenty five degrees but can range from around fifteen degrees to around thirty degrees.

A double claw 15, 17 is provided at the free end 19 of the one flat end portion 7. The two claws 15, 17 are formed by a narrow, thin, elongate claw member 21 extending across the free end 19 of the end portion 7. The claw member preferably has a generally rectangular cross-section. The claw member 21 can be straight but is preferably slightly curved to bend back toward the handle at its ends as shown in FIG. 2. The claw member 21 is centred with respect to the free end 19 of the end portion 7, as shown in FIGS. 2 and 3, and welded to it with one side of the claw member 21 on one side of the end portion 7 forming one claw 15 and the other side of the claw member 21 forming the other claw 17.

Each claw 15, 17 is tapered, looking at its narrow side, towards its free end to provide a straight end edge 22, 23. This end edge 22, 23 is transverse to the straight end section 11 and parallel to a straight imaginary plane that bisects the width of the entire handle. A narrow v-shaped slot 25, 27 extends inwardly from the centre of the edges 22, 23 to complete the claws 15, 17. The slots 25, 27 at the ends of the claws 15, 17 normally have a wide mouth 29 to be able to grab an edge of the article being removed by the tool. The mouth 29 of each slot is wider than half the length of the edges 22, 23. The claw member 21 forming the claws cannot be very wide since it has to fit under an article such as roof flashing. The claw member 21 normally has a height about half the diameter of the main tubular body portion of the handle.

The other flat end portion 9 of the handle 3 is also tapered on its narrow side to form a straight edge 33. A v-shaped, fastener receiving slot 35 extends inwardly from the edge 33. The end portion 9 is used to lift nails or other fasteners off the surface being worked on, the bend 37 in the end portion serving as a fulcrum around which the edge 33 can be levered up by the handle 3. The curved end portion 9 also serves to raise the rear of the main body portion 5 of the handle 3 when the tool is laid down on the surface being worked on so that the tool is easy to grasp for use.

Figure 5:
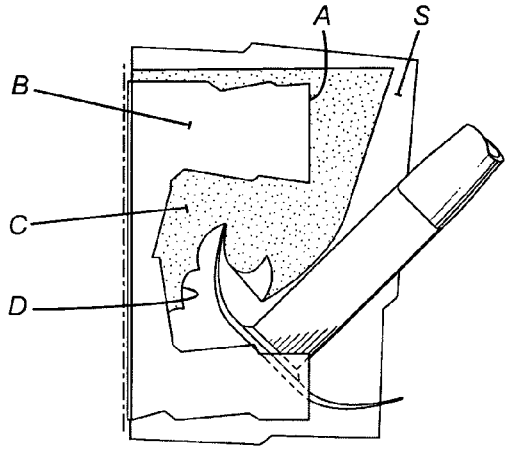
FIG. 5 is a partial top view of the tool being used with the permanent article partly cut away.

In use, the tool is manipulated by the handle 3 to slide one of the claws 15, 17 under the edge A of the permanent article B covering the article C to be removed as shown in FIGS. 4 and 5. Because the flat end portion 7 of the handle 3 is bent upwardly, the tool can be manipulated to first place one straight edge 21 of one claw 15 flat on the surface to slide it under the edge A of the permanent article B and then manipulated again to place one narrow edge 41 of the claw member 21 flat on the surface S supporting the article C with the handle 3 still angled up from the surface S so the tool can be gripped. The tool is manipulated to have one claw 15 moved under the permanent article B to a position to grip the article C by its edge D within the v-shaped slot 25 on the claw. The claw can be moved up to four or five inches under the permanent article B. A portion of the article C is wedged tight within the slot 25 by manipulating the tool to locate and move the claw, and the claw is then pivoted out from under the article B to pull the wedged portion, and more, of the article C out from underneath the article B. The tool can be worked along the edge A of the permanent article B covering the article or articles C to remove all the portions under the flashing. With a double claw arrangement, the tool can be used with the permanent article B on the left side or the right side of the user.

Figure 6:
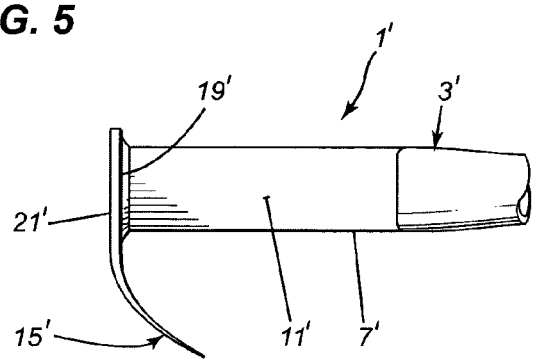
FIG. 6 is partial top view of a modified tool.

While a double claw arrangement has been described on the tool, a tool with only one claw can be used as well. The claw member is simply modified to eliminate one of the claws while leaving enough material on the member to provide one claw and sufficient material to attach it to the handle. An example of a tool with one claw is shown in FIG. 6 where the tool 1' has only one claw 15' attached to the free end 19' of the straight section 11' of the one end portion 7' of the tool handle 3'. The claw member 21 has the one claw 17 cut off to form a new claw member 21' with only a single claw 15'.

It is to be understood that in talking about the article being removed, the term 'article' is also meant to include portions of articles and portions of sheets of material. The tool described is very useful for roofers in reshingling. In removing the used shingles, many times the shingles being removed are torn leaving shingles portions under flashing. It is these shingle portions that the tool is particularly designed to remove. The tool can however be also used to remove portions of large sheets of roofing membranes.

I claim:

1. A pulling tool comprising a handle, the handle having a straight main body portion and a flat end portion extending from one end of the body portion, the one flat end portion terminating in a first end edge, the long dimension of the end edge being perpendicular to an imaginary straight plane bisecting the width of the entire handle, a thin, narrow, claw member immovably fixed to the first end edge of the end portion and extending across and past both sides of the end portion to form a claw on each side of the handle, each claw having a free end; the free end of the claw being tapered to form a second end edge which second end edge is parallel to the imaginary straight plane, and a narrow v-shaped material receiving slot extending inwardly from the second end edge on the claw, the one flat end portion being bent to have the straight main body portion extend upwardly and rearwardly when the claw member is resting on said claw members bottom side edge on a horizontal surface.

2. A pulling tool as claimed in claim 1 wherein the end portion terminates in a straight section carrying the first end edge.

3. A pulling tool as claimed in claim 2 wherein the straight section extends at an angle to the body portion of the handle that ranges between fifteen degrees and thirty degrees.

4. A pulling tool as claimed in claim 3 wherein the handle has a second flat end portion extending from the other end of the body portion of the handle, the second end portion bent from the body portion in a direction opposite to the direction the first end portion is bent from the body portion, the second end portion terminating at its free end in a third end edge, the third end edge parallel to the first end edge, and a fastener receiving slot extending inwardly from the third end edge of the second end portion.

5. A pulling tool as claimed in claim 2 wherein the handle has a second flat end portion extending from the other end of the body portion of the handle, the second end portion bent from the body portion in a direction opposite to the direction the first end portion is bent from the body portion, the second end portion terminating at its free end in a third end edge, the third end edge parallel to the first end edge, and a fastener receiving slot extending inwardly from the third end edge of the second end portion.

6. A pulling tool as claimed in claim 1 wherein the handle has a second end portion extending from the other end of the body portion of the handle, the second end portion tapering at its free end to a third end edge, the third end edge parallel to the first end edge, and a fastener receiving slot extending inwardly from the second end edge of the second end portion.

* * * * *